US007159352B1

(12) United States Patent
Lefebvre et al.

(10) Patent No.: US 7,159,352 B1
(45) Date of Patent: Jan. 9, 2007

(54) END CAP APPARATUS

(76) Inventors: Daniel Lefebvre, 65 Cliffside Dr., Wallingford, CT (US) 06492; David Black, 303 Hemlock Dr., Orange, CT (US) 06477; Glenn Golden, 294 Grieb Rd., Wallingford, CT (US) 06492; Christopher Wiegert, 90 Liney Hall La., Wallingford, CT (US) 06492

( * ) Notice: Subject to any disclaimer, the term of this patent is extended or adjusted under 35 U.S.C. 154(b) by 150 days.

(21) Appl. No.: 10/796,434

(22) Filed: Mar. 9, 2004

Related U.S. Application Data

(60) Provisional application No. 60/453,844, filed on Mar. 11, 2003.

(51) Int. Cl.
*G09F 3/18* (2006.01)

(52) U.S. Cl. ..... 40/661.03; 40/649; 248/201

(58) Field of Classification Search ..... 40/649, 40/661.03; D20/43, 44; 248/251, 254, 255, 248/262, 263, 267, 201
See application file for complete search history.

(56) References Cited

U.S. PATENT DOCUMENTS

| | | | | |
|---|---|---|---|---|
| 2,787,382 | A * | 4/1957 | Williams | 108/157.13 |
| 2,936,904 | A * | 5/1960 | Streater | 108/28 |
| 4,557,064 | A | 12/1985 | Thompson | |
| 4,688,341 | A * | 8/1987 | Castel | 40/5 |
| 4,753,026 | A * | 6/1988 | Woodman et al. | 40/584 |
| 5,097,611 | A * | 3/1992 | Smollar et al. | 40/514 |
| 5,233,773 | A | 8/1993 | Reynolds | |
| 5,241,467 | A | 8/1993 | Failing | |
| 5,394,632 | A | 3/1995 | Gebka | |
| 5,465,516 | A * | 11/1995 | Stabile | 40/649 |
| 5,488,793 | A | 2/1996 | Gebka | |
| 5,611,512 | A | 3/1997 | Cholet | |
| 5,966,854 | A * | 10/1999 | Walsh et al. | 40/514 |
| 6,026,603 | A * | 2/2000 | Kump et al. | 40/661.03 |
| 6,035,569 | A | 3/2000 | Nagel | |
| 6,069,596 | A | 5/2000 | Marvin | |
| 6,107,936 | A | 8/2000 | Zimmerman | |
| 6,119,990 | A | 9/2000 | Kump | |
| 6,126,125 | A | 10/2000 | Dalton | |
| 6,142,322 | A | 11/2000 | Smith | |
| 6,357,606 | B1 * | 3/2002 | Henry | 211/59.3 |
| 6,551,738 | B1 | 4/2003 | Kwan | |
| 6,553,702 | B1 | 4/2003 | Bacnik | |
| 6,571,498 | B1 | 6/2003 | Cyrfuk | |
| 2003/0196979 | A1 | 10/2003 | Cyrfuk | |

* cited by examiner

*Primary Examiner*—Gary C. Hoge
(74) *Attorney, Agent, or Firm*—Raymond A. Nuzzo; Raymond Nuzzo

(57) ABSTRACT

The present invention is directed to an end cap apparatus. In one embodiment, the elongate base member has a support member, and at least one bracket attached to the support member to allow the elongate base member to be attached to a structure. The end cap apparatus also has a price label containment member secured to the support member of the elongate base member for displaying a price label.

17 Claims, 10 Drawing Sheets

END CAP APPARATUS

CROSS-REFERENCE TO RELATED APPLICATIONS

This application claims the benefit of commonly owned and copending U.S. Provisional Application Ser. No. 60/453,844, filed Mar. 11, 2003.

BACKGROUND OF THE INVENTION

1. Field of the Invention

The present invention relates to an end cap for holding a price label.

2. Problem to be Solved

When a retail store, such as a grocery store, offers products for sale on shelves, store employees typically attach hand written or pre-printed signs or other advertisements to the shelves in order to inform customers of price or product information. Such a practice is time consuming and inconvenient. Furthermore, many retail stores utilize the space at the end of the aisle-long shelf units between aisles to display merchandise. This would require additional hand written or pre-printed signs. Additionally, retail stores sometimes utilize semi-circular or arc-shaped shelves at the end of the aisle-long shelf units. The shape of these shelves makes it difficult to attach such hand-written or pre-printed signs.

SUMMARY OF THE INVENTION

The present invention is directed to an end cap that can retain a plurality of price labels, electronic price labels or electronic shelf labels that inform customers of product and/or price information. The end cap is removably attached to a shelf or other structure used to display products and merchandise.

In one embodiment, the present invention is directed to an end cap apparatus comprising an elongate base member comprising a support member, and at least one bracket attached to the support member to allow the elongate base member to be attached to a structure such as a shelf or table. The end cap apparatus further comprises a price label containment member secured to the support member of the elongate base member for displaying a price label.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DETAILED DESCRIPTION OF THE INVENTION

In the description of the invention various embodiments and/or individual features are disclosed. As will be apparent to the ordinarily skilled practitioner, all combinations of such embodiments and features are possible and can result in preferred executions of the invention.

In describing the preferred embodiments of the present invention, reference will be made herein to FIGS. 1–15 of the drawings in which like numerals refer to like features of the invention.

Definitions

As used herein, the term "price label" includes electronic price labels (known as EPLS), electronic shelf labels (known as ESLs), non-electronic labels, flexible electronic or non-electronic price label, electronic or non-electronic thin labels, and non-electronic price labels. Examples of electronic price labels and electronic shelf labels with which the present invention can be used are generally described in U.S. Pat. Nos. 6,107,936 and 6,551,738, the disclosures of which patents are incorporated herein by reference.

Figure 3:
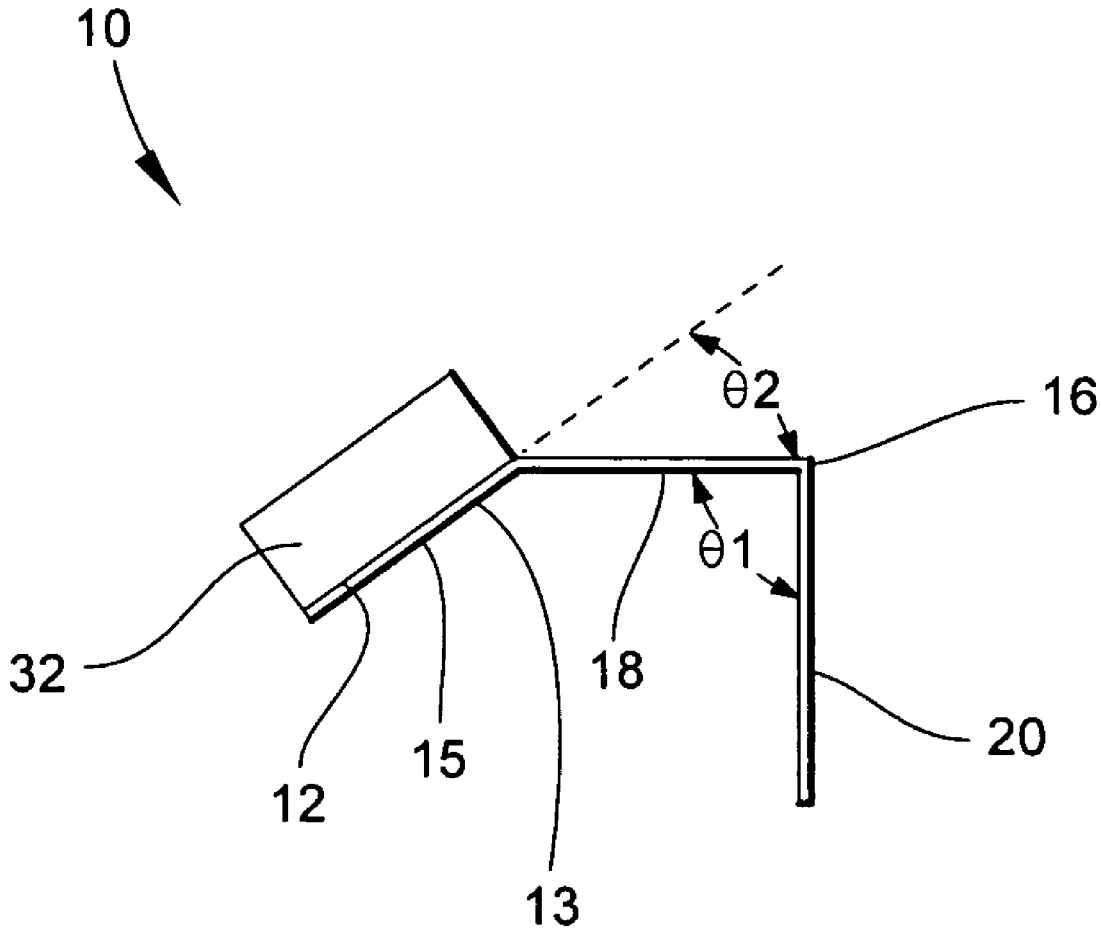
FIG. 3 is a side elevational view of the end cap apparatus of the present invention.
Figure 4:
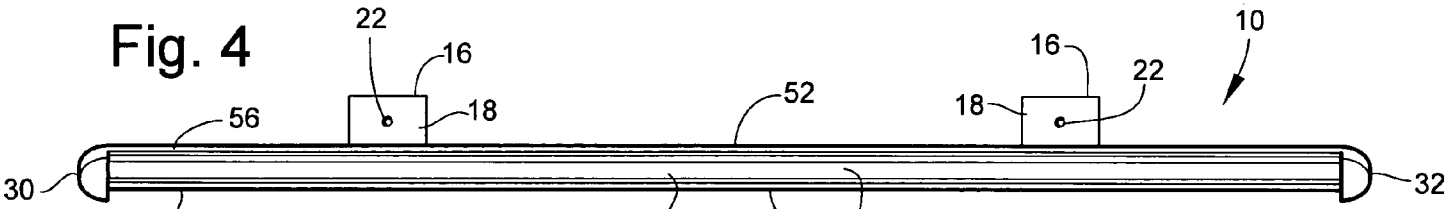
FIG. 4 is another perspective view of the end cap of the present invention showing the front side of the end cap apparatus.
Figure 5:
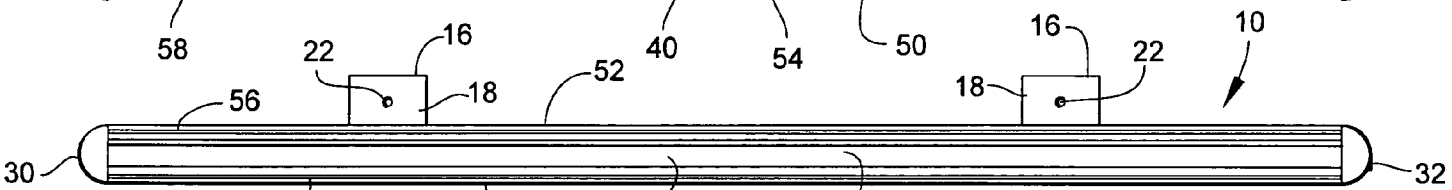
FIG. 5 is front elevational view of the end cap apparatus of the present invention.
Figure 6:
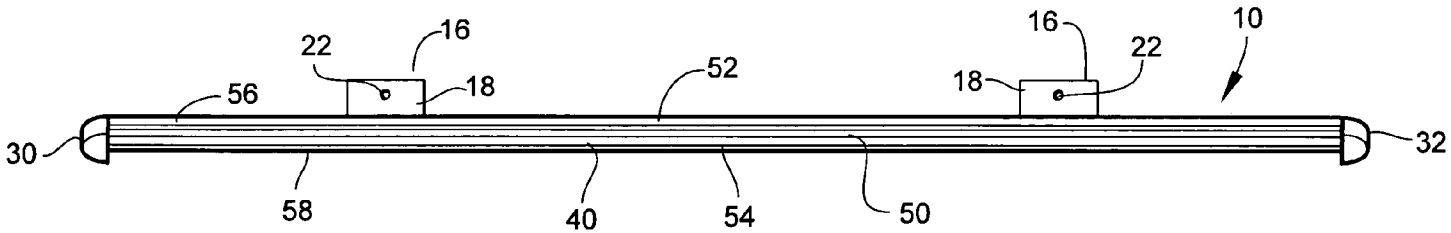
FIG. 6 is a further perspective view of the end cap of the present invention.
Figure 7:
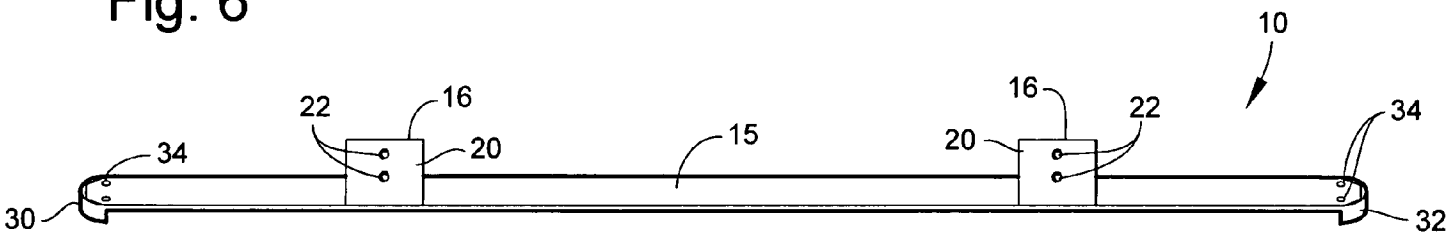
FIG. 7 is a perspective view of the rear of the end cap apparatus of the present invention.
Figure 8:
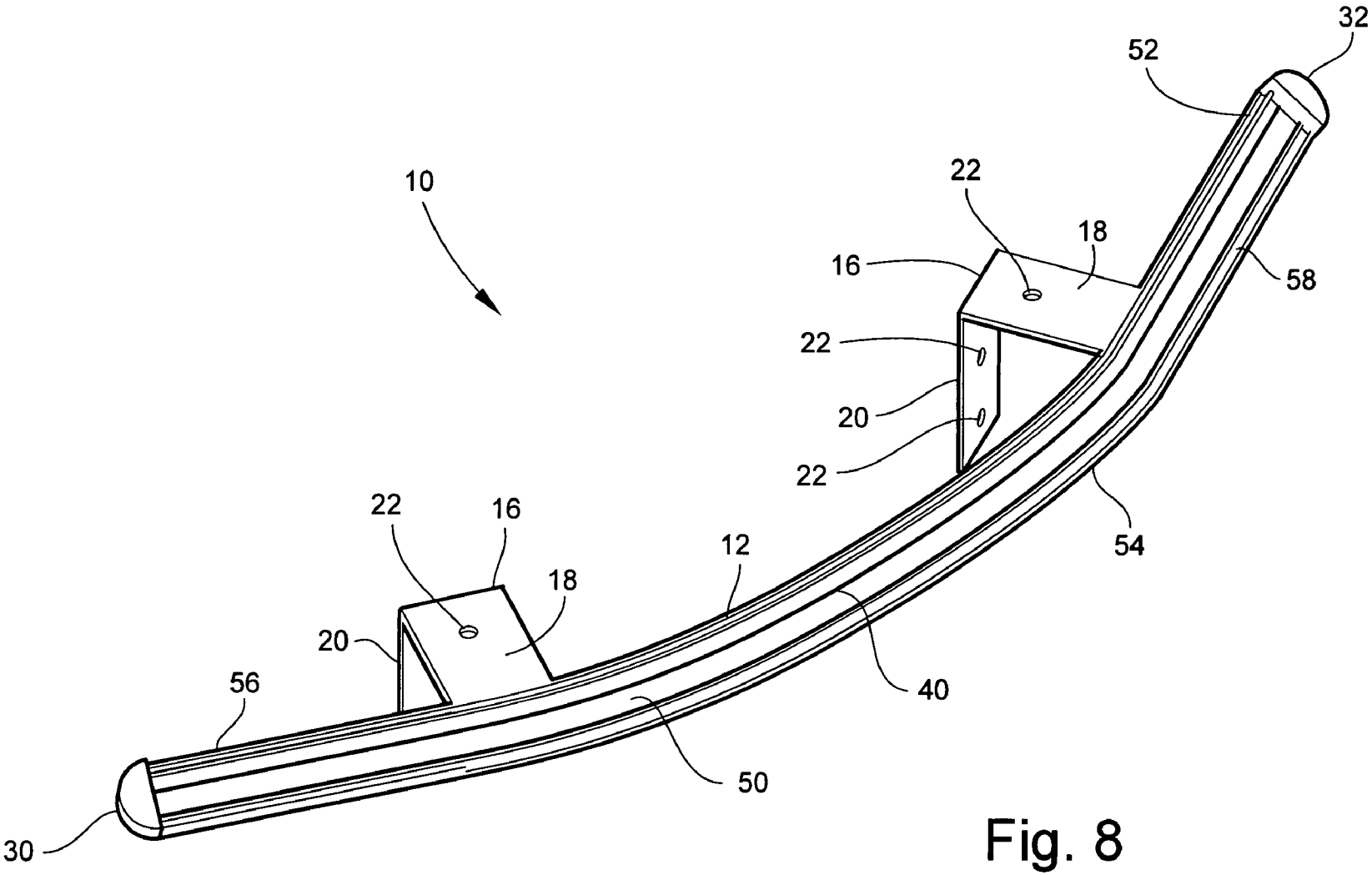
FIG. 8 is perspective view of the end cap apparatus of the present invention illustrating the flexibility and resiliency of the end cap apparatus of the present invention.

Referring to FIGS. 1–8, there is shown end cap apparatus 10 of the present invention. End cap apparatus 10 generally comprises base member 12. Base member 12 comprises support member 13. Support member 13 has front side 14 and rear side 15 (see FIG. 7). In a preferred embodiment, front side 14 is substantially planar. Base member 12 further includes brackets 16 that are attached to support member 13. Each bracket 16 has a first portion 18 and a second portion 20. In one embodiment, first portion 18 is angulated with respect to second portion 20 by angle $\theta_1$ (see FIG. 3). In a preferred embodiment, angle $\theta_1$ is 90 degrees. However, it is to be understood that angle $\theta_1$ can be any other suitable angle. First and second portions 18 and 20, respectively, have openings 22. Fastening devices (not shown) such as screws, tacks, nails, etc. are inserted into openings 22 in order to removably attach base member 12 to a structure such as a shelf, table, pallet or other suitable structure. Referring to FIG. 3, in a preferred embodiment, support member 13 is angulated by angle $\theta_2$ degrees with respect to portion 18 of each bracket 16. Preferably, the angle $\theta_2$ is between about 30 degrees and 45 degrees. In a more preferred embodiment, the angle $\theta_2$ is about 45 degrees. It is to be understood that angle $\theta_2$ can be any other suitable angle. Thus, angles $\theta_1$ and $\theta_2$ can be varied to facilitate attachment of base member 12 to a variety of structures (e.g. shelf, table, etc.) having various elevations with respect to the floor. In accordance with the present invention, base member 12 is made from a material that has strength, resiliency and flexibility such as aluminum or plastic so as to allow base member 12 to flex as shown in FIG. 8. However, it is to be understood that other suitable flexible and resilient materials can be used to fabricate base member 12. Such flexibility allows base member 12 to be used on the edges of generally semi-circular or arcuate shelves or tables.

Figure 1:
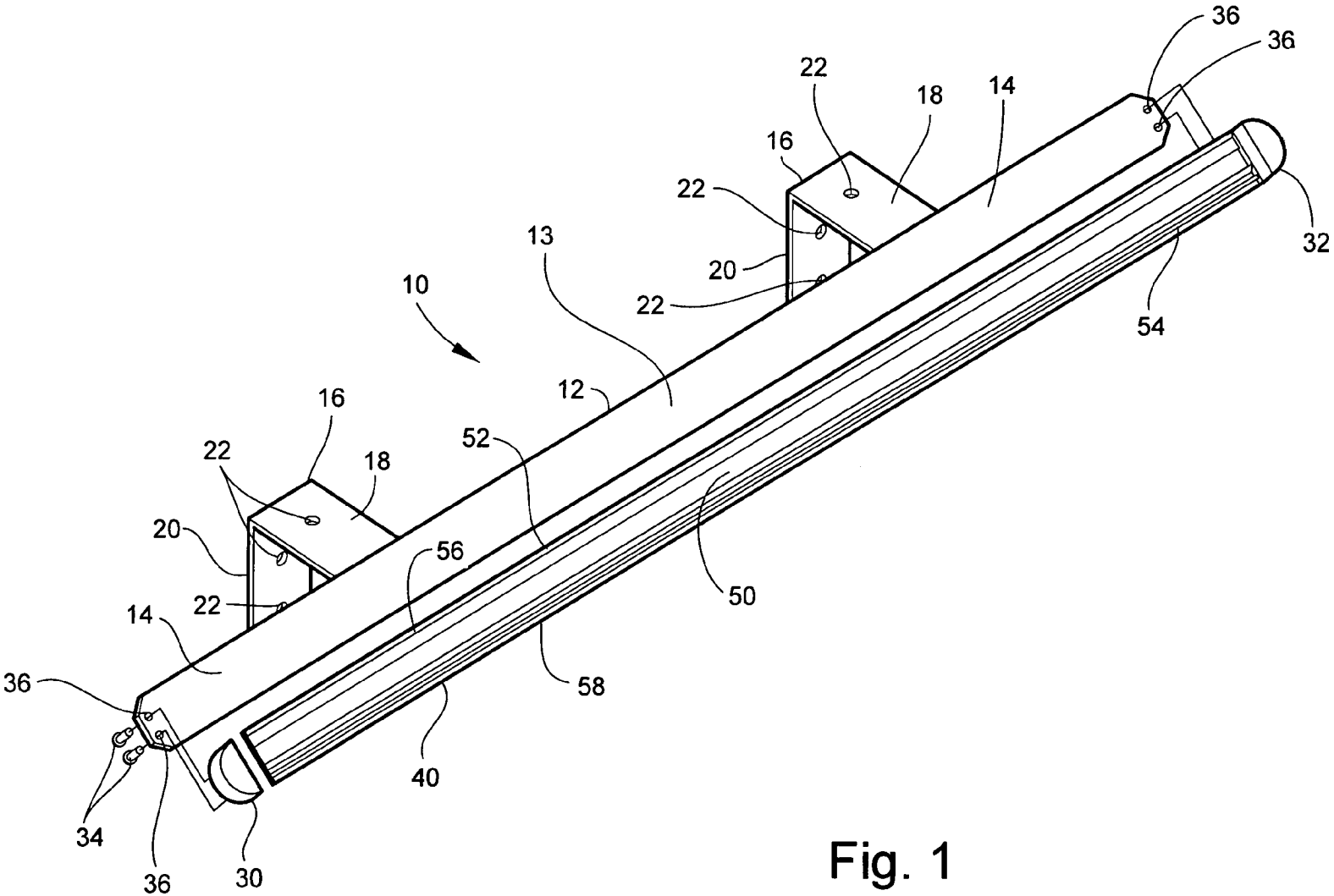
FIG. 1 is an exploded view, in perspective, of the end cap apparatus of the present invention, the view showing a base member and a price label containment member.

Referring to FIGS. 1, 2 and 4–8, end cap apparatus 10 further includes guards 30 and 32 that are removably attached to front side 14. In one embodiment, guards 30 and 32 are removably attached to front side 14 with screws 34 that are inserted into openings 36 in support member 13. This embodiment is shown in FIG. 1. In one embodiment, guards 30 and 32 are made of plastic. However, guards 30 and 32 may be fabricated from other suitable materials, e.g. rubber. In a preferred embodiment, guards 30 and 32 have a rounded and smooth shape that reduces the chances of objects, such as shopping carriages or a peoples' clothing, from becoming entangled on the edges of base member 12.

Figure 1A:
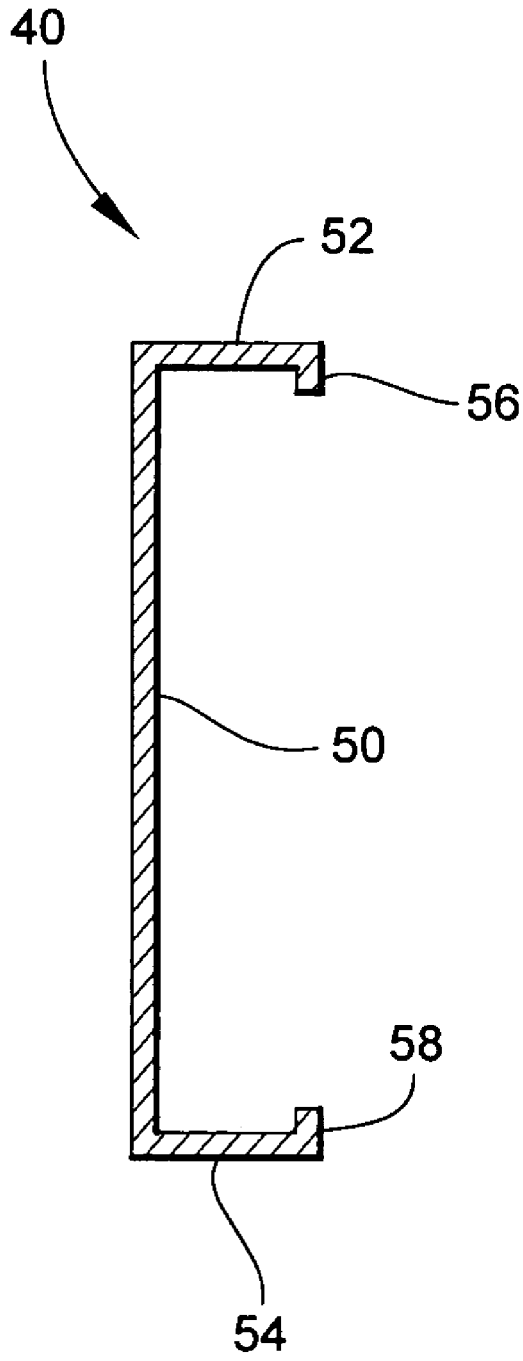
FIG. 1A is a cross-sectional view of the price label containment member shown in FIG. 1.
Figure 2:
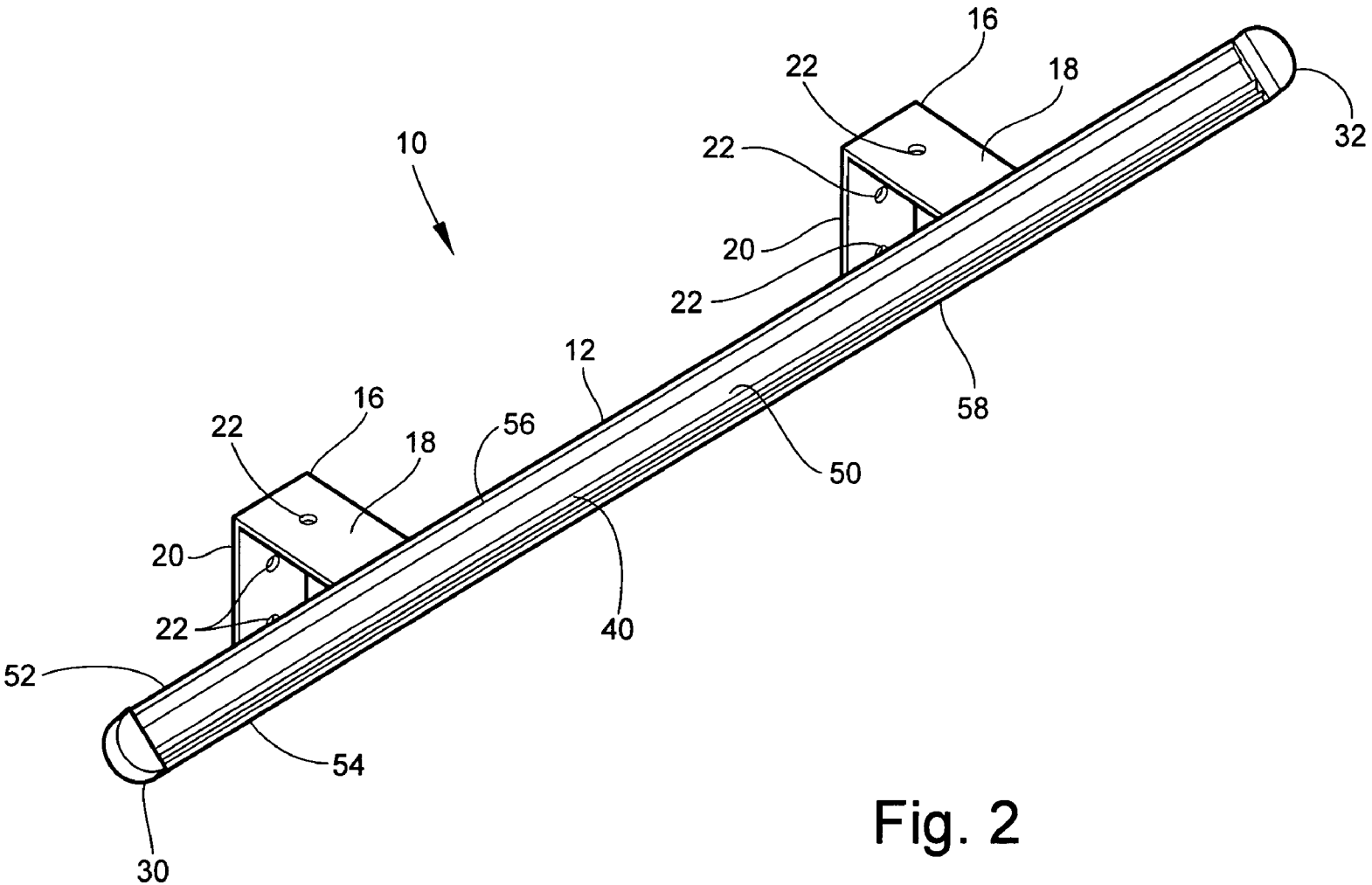
FIG. 2 is a perspective view of the end cap apparatus of the present invention completely assembled.
Figure 9:
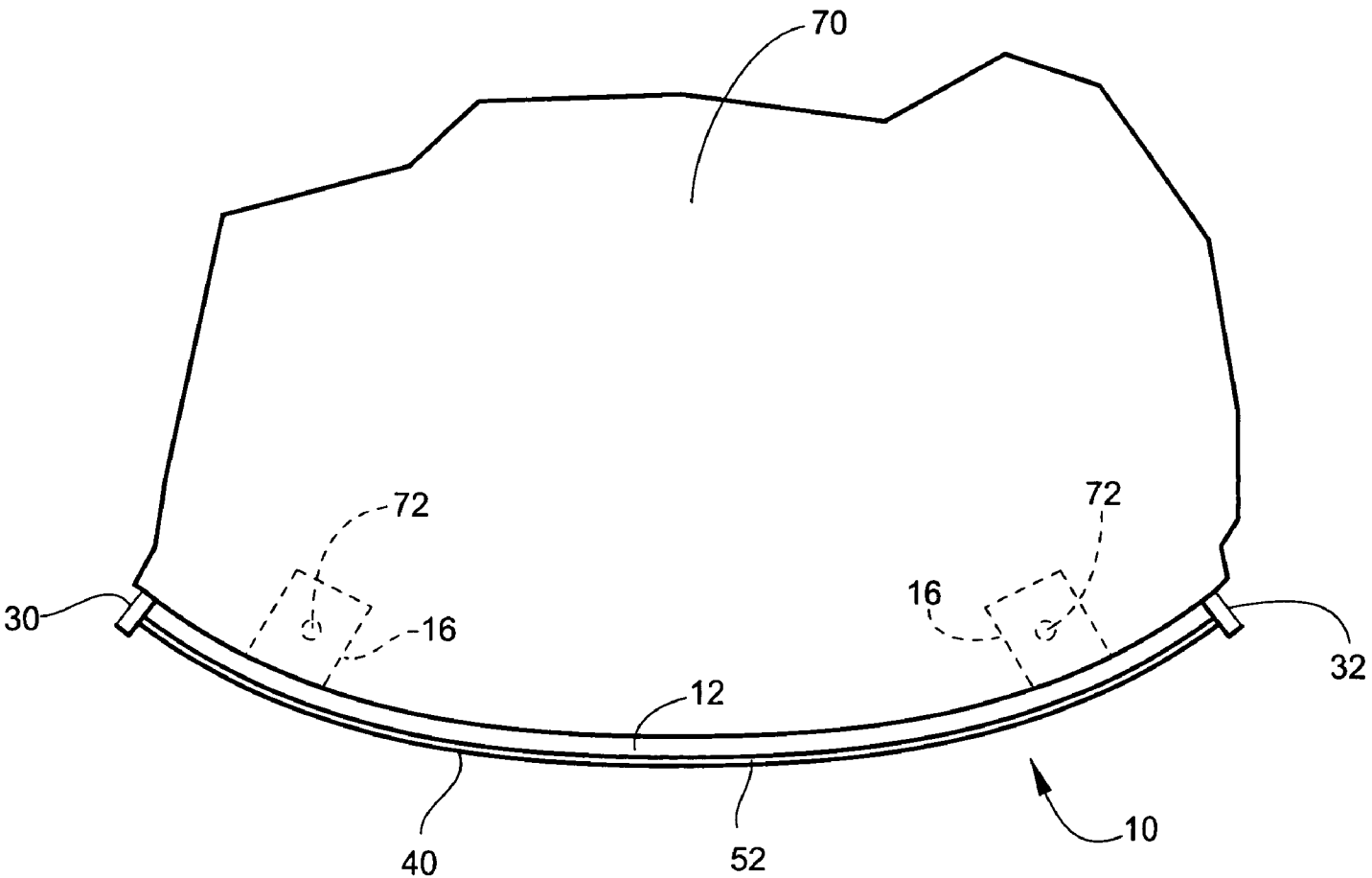
FIG. 9 is a top view showing the end cap apparatus of the present invention attached to a generally arcuate shelf.

Referring to FIGS. 1–6 and 8, end cap apparatus 10 further comprises price label containment member 40 that is attached to front side 14 of support member 13. Price label containment member 40 is positioned between guards 30 and 32. In one embodiment, containment member 40 is adhered to front side 14 with an adhesive or an adhesive tape. In another embodiment, containment member 40 is removably attached to front side 14 with fasteners (not shown) such as screws or rivets. Containment member 40 includes rear or back wall 50, and lengthwise flanged end portions 52 and 54. In a preferred embodiment, lengthwise flanged end portions 52 and 54 are generally perpendicular to back wall 50. Lengthwise flanged end portion 52 includes lip 56 and lengthwise flanged end portion 54 includes lip 58 (see FIG. 1A). Lips 56 and 58 extend inward in a generally vertical direction. In one embodiment, lips 56 and 58 are generally perpendicular to lengthwise flanged end portions 52 and 54, respectively. Containment member 40 is preferably made of molded or extruded plastic. Lengthwise flanged end portions 52 and 54, respectively, are separated by a predetermined distance that allows for a price label to be frictionally inserted between lengthwise flanged end portions 52 and 54. For example, the rear side of the EPL described in U.S. Pat. No. 6,551,738 can be frictionally inserted between lengthwise end portions 52 and 54. In one embodiment, lips 56 and 58 can be frictionally inserted into grooves or channels that may be formed in an electronic price label or electronic shelf label. Thus, it is to be understood that the shape of containment member 40, including the shape of lengthwise flanged end portions 52 and 54 and lips 56 and 58, can be varied so as to accommodate back sides of EPLs or ESLs that have different shapes. In a preferred embodiment, containment member 40 is made from a material that is strong, but yet, allows containment member 40 to be flexed as shown in FIG. 8. End cap apparatus 10 can be flexed so as to facilitate attachment of end cap apparatus 10 to a semi-circular or arc-shaped shelf. Such a configuration is shown in FIG. 9 which is a top plan view showing end cap apparatus 10 attached to semi-circular or arc-shaped shelf 70. Brackets 16 are under shelf 70 and therefore are shown in phantom. Fasteners 72, such as screws, are used to attach end cap apparatus 10 to shelf 70. In one embodiment, price label containment member 40 is fabricated from extruded resin.

Figure 10:
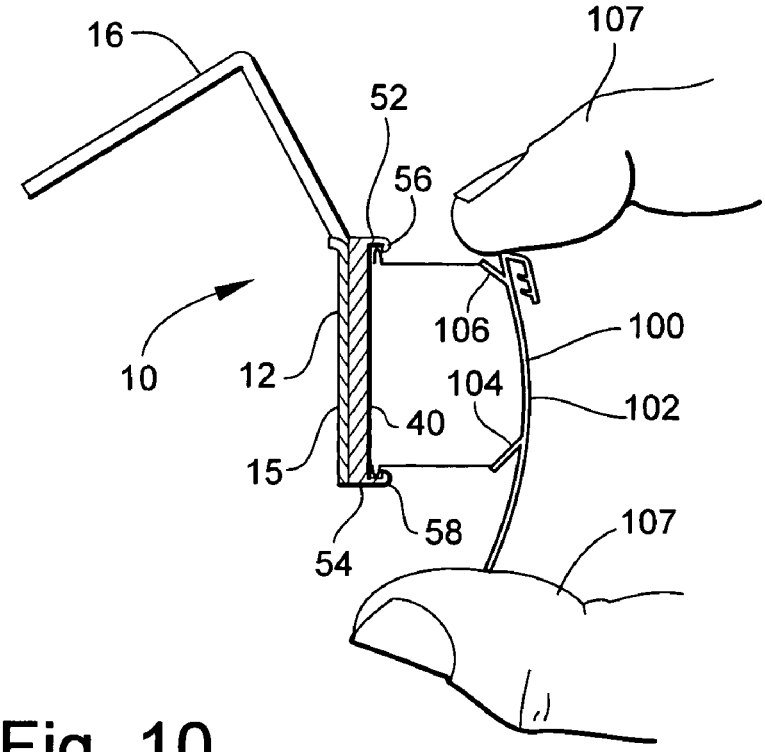
FIG. 10 is an exploded view, partially in cross-section, illustrating how a price card holder may be secured to the end cap apparatus of the present invention.
Figure 11:
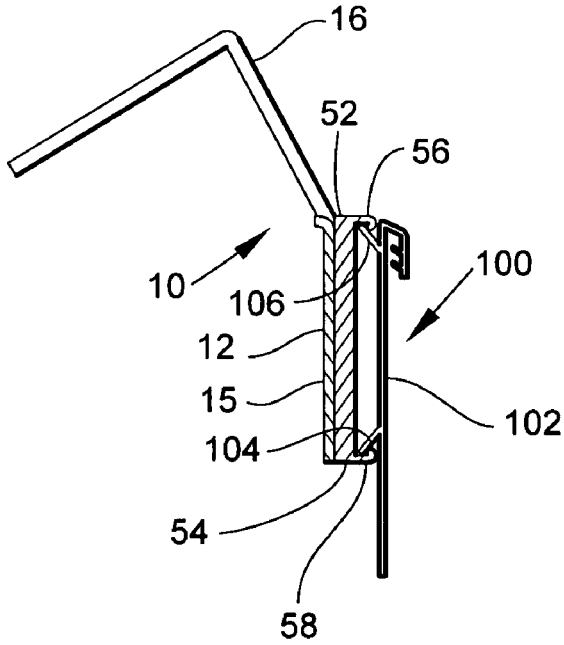
FIG. 11 is a side elevational view, partially in cross-section, showing the price card holder of FIG. 10 secured to the end cap apparatus of the present invention.

It is to be understood that although the foregoing description is in terms of containment member 40 being used to retain price labels, it is to be understood that containment member 40 can be used to retain price cards holders. One example of such a price card holder is shown as price card holder 10 in U.S. Pat. No. 4,557,064, the disclosure of which is incorporated herein by reference. This is illustrated in FIGS. 10 and 11 of the present application. Price card holder 100 has the same construction as price card holder 10 shown in U.S. Pat. No. 4,557,064. Price card holder 100 has support portion 102 and outwardly extending ledges 104 and 106. Price card holder 100 may be flexed by a user's fingers 107 so that outwardly extending ledges 104 and 106 can be positioned between lengthwise end portions 52 and 54 of containment member 40 (see FIG. 11).

Figure 12:
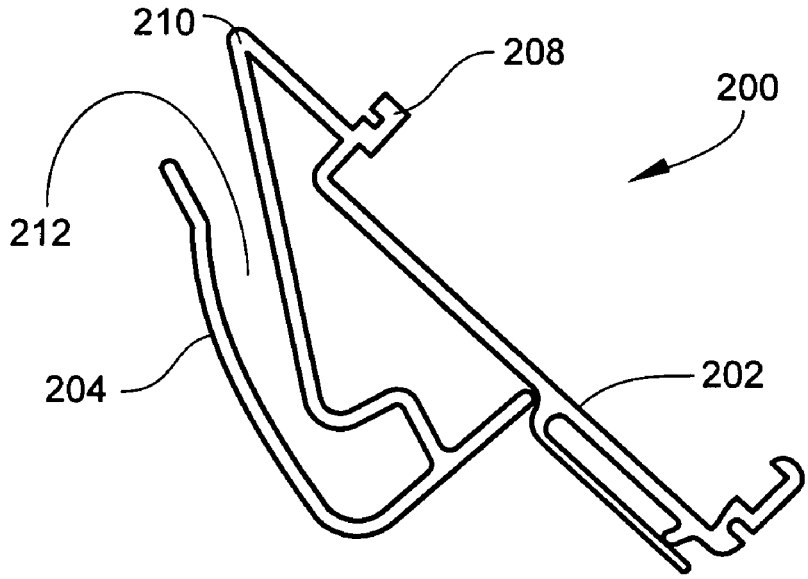
FIG. 12 is a side elevational view of another type of price label containment member that may be secured to the base member shown in FIG. 1.
Figure 13:
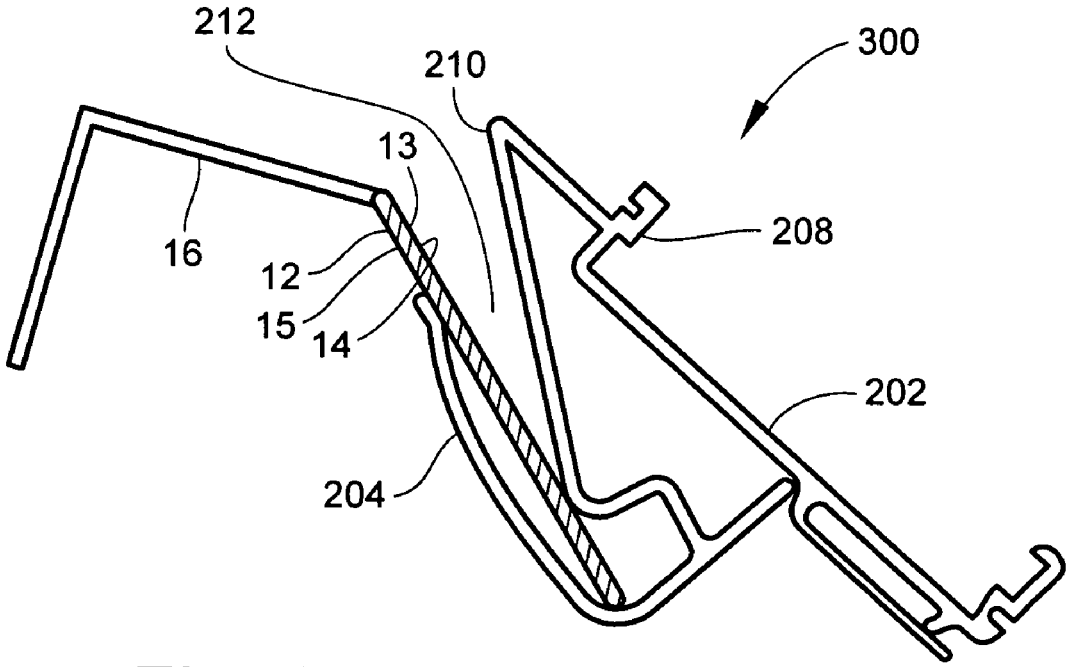
FIG. 13 is a side elevational view, partially in cross-section, showing the price label containment member of FIG. 12 secured to the base member shown in FIG. 1.

Referring to FIG. 12, there is shown an alternate price label containment member 200 which is used with base member 12 instead of containment member 40 described in the foregoing description. Containment member 200 is configured to have the same structure as price label holder 10 described in U.S. Pat. No. 6,553,702 and shown in FIG. 1A of that patent. The disclosure of U.S. Pat. No. 6,553,702 is incorporated herein by reference. A detailed description of containment member 200 is not necessary here since the structure of containment member 200 is identical to the structure of price label holder 10 shown in the U.S. Pat. No. 6,553,702. Containment member 200 comprises base channel 202 that has an overall C-shape conformation to slidably accommodate and frictionally retain an associated electronic price label. Containment member 200 further comprises L-shaped clip portion 204 connected to the C-channel 202 by way of top wall 208 and connecting arm 210. The L-shaped clip portion 204 and connecting arm 210 define an upwardly open slot or channel 212 therebetween which is sized to frictionally receive support member 13 of base member 12. Referring to FIG. 13, there is shown end cap apparatus 300 which comprises base member 12 and containment member 200 wherein support member 13 of base member 12 is positioned in slot 212 and frictionally engages clip 204 and a portion of wall 210. Containment member 200 extends for substantially the entire length of base member 12. In accordance with the invention, containment member 200 is fabricated from flexible and resilient material to allow containment member 200 to flex in the event end cap apparatus 300 is used on a semi-circular or arcuate shelf. In one embodiment, price label containment member 200 is fabricated from extruded resin.

Figure 14:
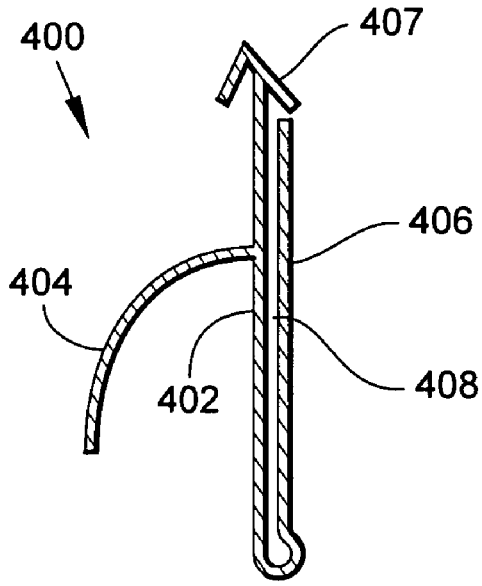
FIG. 14 is a side elevational view, in cross-section, of another type of price label containment member that may be secured to the base member shown in FIG. 1.
Figure 15:
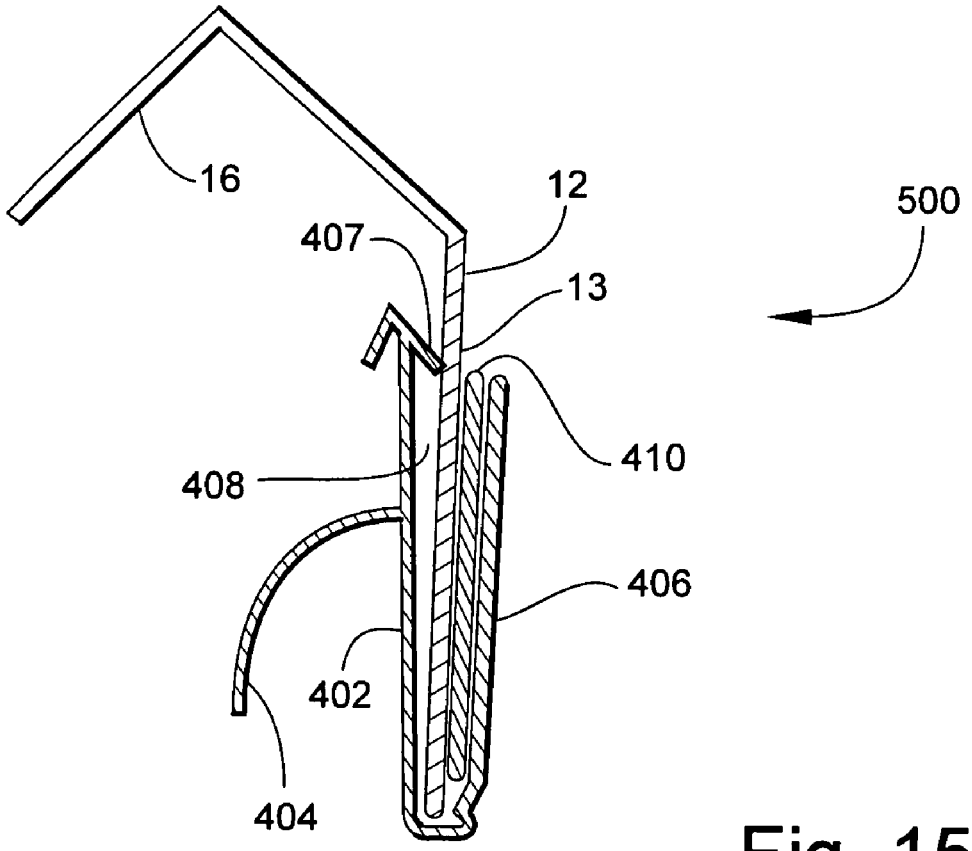
FIG. 15 is a side elevational view, partially in cross-section, showing the price label containment member of FIG. 14 secured to the base member shown in FIG. 1.

Referring to FIG. 14, there is shown an alternate price label containment member 400 which is used with base member 12 instead of containment member 40 described in the foregoing description. Containment member 400 is configured to have the same structure as extruded plastic snap-in price channel 10 described as prior art and shown in FIG. 2 in U.S. Pat. No. 5,394,632. The disclosure of U.S. Pat. No. 5,394,632 is incorporated herein by reference. Thus, containment member 400 comprises labeling panel 402, rearwardly extending leg 404 and co-extruded clear plastic front cover 406. Labeling panel 402 has a barbed top portion 407. Slot or channel 408 is defined between labeling panel 402 and front cover 406. The dimensions of slot 408 allow support member 13 of base member 12 to be inserted in slot 408 so as to frictionally contact barbed portion 407 and front cover 406. Referring to FIG. 15, there is shown end cap 500 which comprises base member 12 and containment member 400 wherein support member 13 of base member 12 is positioned in slot 408. Also positioned between support member 13 and front cover 406 is a non-adhesive price label 410. Containment member 400 extends for substantially the entire length of base member 12 and thus, a plurality of non-adhesive price labels, such as label 410, can be secured between support member 13 and front cover 406. In accordance with the invention, containment member 400 is fabricated from flexible and resilient material to allow containment member 400 to flex in the event end cap 500 is used on a semi-circular or arcuate shelf. In one embodiment, price label containment member 400 is fabricated from extruded resin.

It is to be understood that the overall size of any of the foregoing embodiments of the end cap apparatuses of the present invention can be varied to accommodate price labels of different types and sizes.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A price label display apparatus for use with a product display structure, the price label display apparatus comprising:

a base member comprising:

a support member having a front side and an opposite rear side, and at least one bracket attached to the support member to allow the base member to be attached to a product display structure, the bracket comprising a first section that is attached to the support member and a second section attached and angulated with respect to the first section, the first section having a top side and opposite bottom side, the second section being angulated with respect to the first section by a first predetermined angle, the support member being angulated with respect to the first section by a second predetermined angle that is measured between the plane within which the support member lies and the top side of the first section of the bracket, the second predetermined angle being between about 30° and 45°; and a price label containment member attached to the front side of the support member.

2. The price label display apparatus according to claim 1 wherein the base member has a length and wherein the price label containment member extends for substantially the entire length of the base member.

3. The price label display apparatus according to claim 2 wherein the base member has a pair of ends, and the price label containment member has a pair of ends, each end of the price label containment member corresponding to one of the ends of the base member, the price label display apparatus further comprising a pair of guards, each guard being attached to one of the ends of the base member.

4. The price label display apparatus according to claim 3 wherein each guard is adjacent to a corresponding end of the price label containment member.

5. The price label display apparatus according to claim 1 wherein the price label containment member comprises a rear wall, and opposing longitudinally extending flanged end portions that define a channel for receiving a price label.

6. The price label display apparatus according to claim 5 wherein the opposing longitudinally extending flanged end portions are generally perpendicular to the rear wall.

7. The price label display apparatus according to claim 5 wherein each longitudinally extending flanged end portion defines an inwardly extending lip, the lips preventing a price label from being dislodged from the channel.

8. The price label display apparatus according to claim 7 further comprising a flexible, resilient price card holder secured to the price label containment member, the price card holder having a front side for displaying a price label, a rear side, and a pair of projecting members extending from the rear portion, each projecting member engaging a corresponding lengthwise flanged end portion and lip of the channel to prevent the price card holder from being dislodged from the price label containment member.

9. The price label display apparatus according to claim 1 wherein the price label containment member is removably attached to the front side of the support member.

10. The price label display apparatus according to claim 1 wherein the price label containment member is adhered to the front side of the support member.

11. The price label display apparatus according to claim 1 wherein the base member is fabricated from a material that allows the base member to be flexible and resilient.

12. The price label display apparatus according to claim 1 wherein the at least one bracket comprises a pair of brackets.

13. The price label display apparatus according to claim 1 wherein the price label containment member is configured to allow an electronic shelf label to be removably connected thereto.

14. The price label display apparatus according to claim 1 wherein the price label containment member is configured to allow an electronic price label to be removably connected thereto.

15. The price label display apparatus according to claim 1 wherein the first predetermined angle is between about 80° and 100°.

16. A price label display apparatus that can be removably connected to a product display structure, the price label support apparatus comprising:

a flexible, elongate base member comprising:

a generally planar support section having a front side and an opposite rear side, and at least one bracket attached to the generally planar support section, the at least one bracket comprising a first section that is attached to the generally planar support section, the first section having a top side and an opposite bottom side, the bracket further comprising a second section attached to the first section, the generally planar support section being angulated with respect to the first section by an angle that is measured between the top side of the first section and the plane within which the generally planar support section lies, the angle being between 30° and 45°, the second section being generally perpendicular to the first section;

means for attaching the at least one bracket to the product display structure;

a price label containment member attached to the front side of the generally planar support section and configured to allow a price label to be removably attached thereto; and wherein the angulation of the generally planar support section with respect to the top side of the first section orients the price label containment member so that a consumer can easily view a price label when such a price label is attached to the price label containment member and the bracket is connected to the product display structure.

17. A price label display apparatus that can be removably connected to a product display structure having a horizontal portion and/or vertical portion, the price label display apparatus comprising:

a flexible, elongate base member comprising:

a generally planar support section having a front side and an opposite rear side, and at least one bracket attached to the generally planar support section, the at least one bracket comprising a first section that is attached to the generally planar support section, the first section having a top side and an opposite bottom side, the bracket further comprising a second section attached to the first section, the generally planar support section being angulated with respect to the first section by an angle that is measured between the top side of the first section and the plane within which the generally planar support section lies, the angle being between about 30° and 45°, the second section being generally, perpendicular to the first section;

wherein the bracket is configured so that it can be attached to either or both of a horizontal portion and vertical portion of a product display structure such that the first section of the bracket is attached to the horizontal portion of the product display structure and/or the second section of the bracket is attached to the vertical portion of the product display structure;

a price label containment member attached to the front side of the generally planar support section and configured to allow a price label to be removably connected hereto; and wherein the angulation of the generally planar support section with respect to the top side of the first section of the bracket orients the price label containment member so that a consumer can easily view a price label when such a price label is connected to the price label containment member and the bracket is connected to the product display structure.

* * * * *